United States Patent [19]

Tanaka

[11] 4,151,679

[45] May 1, 1979

[54] TOY MOBILE OBJECTS AND TRACK THEREFOR

[75] Inventor: Yutaka Tanaka, Tokyo, Japan

[73] Assignee: Toy Town Kogyo Co., Ltd., Tokyo, Japan

[21] Appl. No.: 840,757

[22] Filed: Oct. 11, 1977

[30] Foreign Application Priority Data

Oct. 14, 1976 [JP] Japan ..... 51/123132

[51] Int. Cl.[2] ..... A63H 18/06

[52] U.S. Cl. ..... 46/258; 46/1 K; 46/202; 273/86 B

[58] Field of Search ..... 46/202, 251, 258; 273/86 B

[56] References Cited

U.S. PATENT DOCUMENTS

| | | | |
|---|---|---|---|
| 3,402,503 | 9/1968 | Glass et al. | 46/258 |
| 3,712,541 | 1/1973 | Merino et al. | 273/86 R |
| 3,860,237 | 1/1975 | Cooper et al. | 273/86 R |

*Primary Examiner*—Louis G. Mancene
*Assistant Examiner*—Robert F. Cutting
*Attorney, Agent, or Firm*—Toren, McGeady and Stanger

[57] ABSTRACT

The invention set forth pertains to a toy in which a couple of toy mobile objects which are so constructed as to be separably coupled together in side by side relationship are adapted to be separated from one another during their travel in the coupled state on a track. The track is provided with means for causing the coupled objects to be separated from one another.

7 Claims, 16 Drawing Figures

TOY MOBILE OBJECTS AND TRACK THEREFOR

FIELD OF THE INVENTION

The present invention relates to a toy comprising, in combination, a couple of mobile objects and a track on which said objects are adapted to travel.

SUMMARY OF THE INVENTION

In accordance with the present invention, there is provided a new toy comprising, in combination, a couple of mobile objects arranged to be detachably coupled together in side by side relationship and a track on which said objects are adapted to travel, said track comprising a first runway for guiding the objects in their state of being coupled together in side by side relationship and a pair of second runways for separating the coupled objects and for guiding the objects in their state of being separated from one another, said second runways diverging from said first runway so that as the coupled objects travelling along said first runway pass along the diverging portion, said coupled objects are adapted to be separated from one another.

In one embodiment of the present invention, said second runways connect, at their terminal portions, with said first runway to thereby form a continuous runway means so that as the objects travelling separately along said second runways move into said first runway, said separate objects are adapted to be coupled together in side by side relationship to travel in the coupled state.

It is, therefore, the primary object of the present invention to provide a new toy in which a couple of mobile objects separably coupled together in side by side relationship are caused to be separated from one another during their travel along a track.

Another object of the present invention is to provide a new toy of the kind described in which a couple of mobile objects arranged to be separably coupled together in side by side relationship alternately perform both meeting or coupling action and separating or splitting action, repeatedly.

A further object of the invention is to provide an attractive toy of the type described above which is simple in construction and operation and which can be produced and sold at a reasonable cost.

BRIEF DESCRIPTION OF THE DRAWINGS

The present invention will now be described, by way of example only, with reference to the accompanying drawings which show one embodiment of the invention in which.

DESCRIPTION OF THE PREFERRED EMBODIMENT

Figure 1:
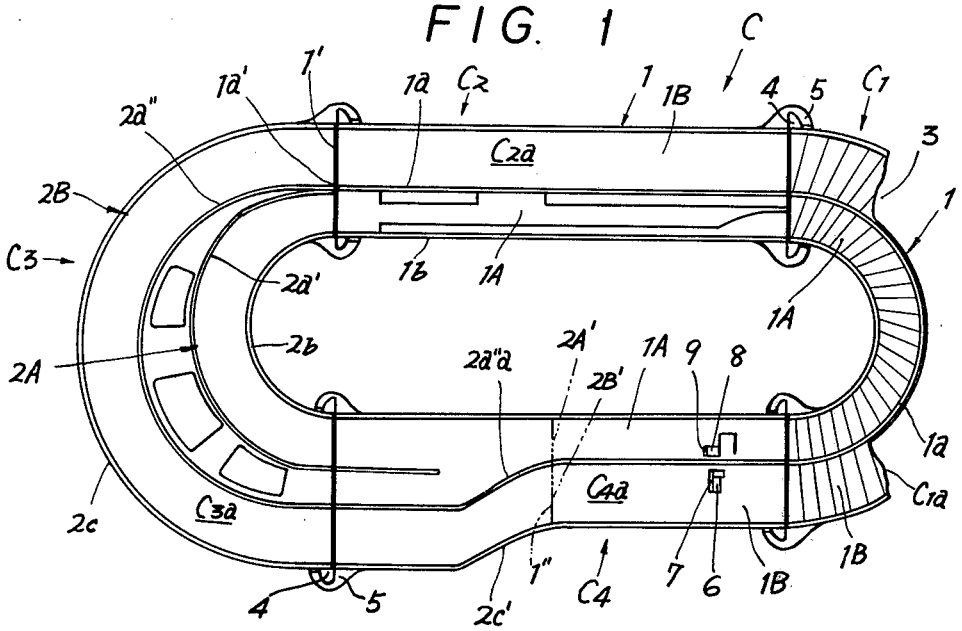
FIG. 1 is a plan view of a track for a couple of mobile objects in the form of a vehicle.
Figure 2:
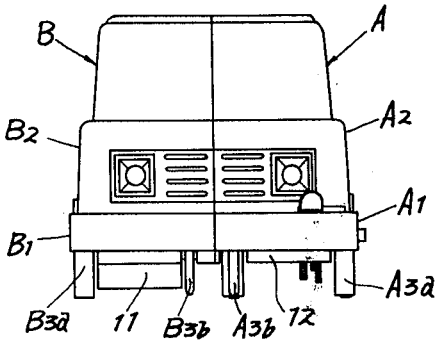
FIG. 2 is a front view of a couple of mobile objects, illustrating the state in which the objects are coupled together in side by side relationship.
Figure 3:
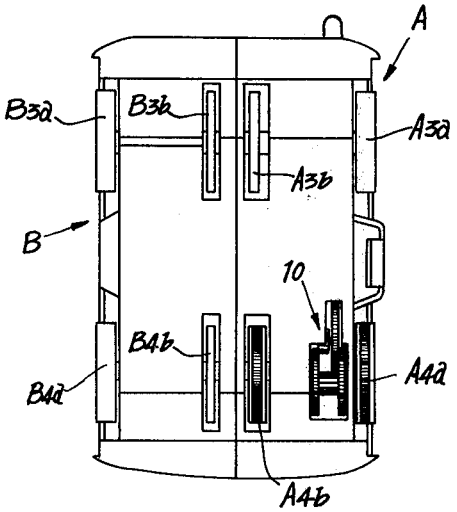
FIG. 3 is a bottom view of FIG. 2.
Figure 4:
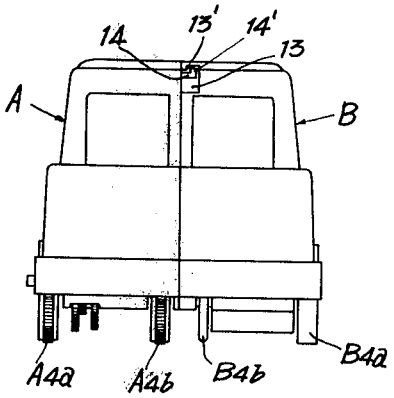
FIG. 4 is a rear view of FIG. 2.
Figure 5:
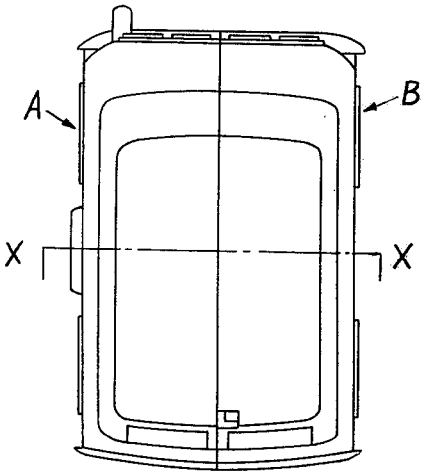
FIG. 5 is a plan view of FIG. 4.
Figure 6:
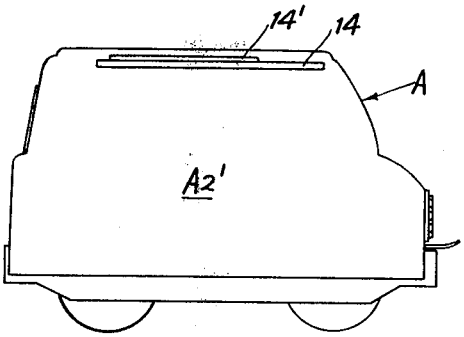
FIG. 6 is a side view of one of the objects.
Figure 7:
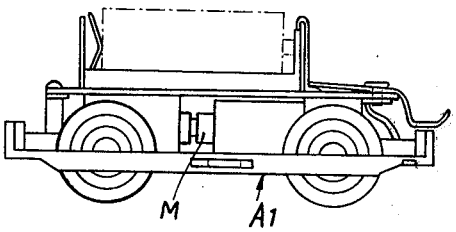
FIG. 7 is a side view of a chassis of the object shown in FIG. 6.
Figure 8:
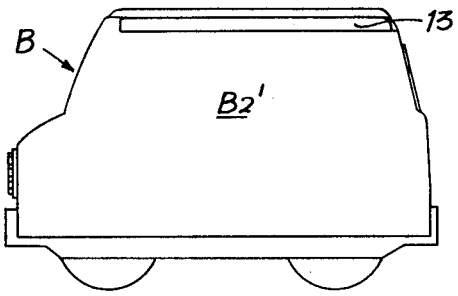
FIG. 8 is a side view of the other of the objects.
Figure 9:
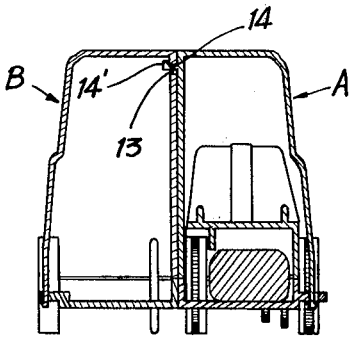
FIG. 9 is a cross-sectional schematic view taken along X—X line of FIG. 5.

Referring now to the drawings, reference characters A and B indicate a couple of mobile objects which are so constructed as to be separably coupled together in side by side relationship and which are each made in the form of a four-wheeled vehicle. Indicated by reference character C is a track for the mobile objects A and B which is constructed so as to be capable of guiding said mobile objects both in their state of being coupled together in side by side relationship and in their state of being separated from one another.

The track C comprises a first runway portion 1 for guiding the couple of objects A and B in their state of being coupled together in side by side relationship and a pair of second runway portions 2A and 2B for guiding the couple of objects A and B in their state of being separate from one another, respectively. The first runway portion 1 is divided into two paths 1A and 1B of travel for the objects A and B. The second runway portions 2A and 2B diverge from one end 1' of said first runway portion 1. In the illustrated embodiment, terminal portions 2A' and 2B' of said second runways 2A and 2B connects with the other end 1'' of said first runway portion 1 to form an endless or closed track means for guiding the objects A and B therealong.

The track C is composed of a plurality of track sections C1, C2, C3 and C4 which are coupled together. Of these track sections, track sections C1 and C3 are curved track sections and track sections C2 and C4 straight track sections in plan views, although track section C4 is slightly deformed. Accordingly, when these track sections C1 to C4 are successively connected together, an elliptical endless track is formed. These track sections comprise plate portions **C1*a*, C2*a*, C3 and C4*a*, respectively. The first runway portion 1 is formed of plate portions C1*a*, C2*a* and C4*a*, a central guide rail 1*a* extending on these plate portions along center axes thereof and bilateral guide rails 1*b* and 1*c* extending on these plate portions along side edges thereof. The paths 1A and 1B of first runway portion 1 are defined by these rails 1*a*, 1*b* and 1*c*. In this connection, it is to be noted that of the plate portions, plate portion C1*a* is partially cut away at outer part thereof to form a cut-out portion 3 in a portion of the outer path 1B of first runway 1 and that plate portion C3*a* is provided with a grade sloping down toward the fourth track section C4**. The purposes for providing these will be described later.

The two runways 2A and 2B are formed of plate portion **C3*a*, part of plate portion C4*a***, a pair of central guide rails 2a' and 2a'' diverging from one end 1a' of the central guide rail 1a of the first runway 1 and leading to the other end 1'' of the first runway portion 1, and bilateral guide rails 2b and 2c extending on the plate portion C3a and part of plate portion C4a along side edges thereof. Thus, the inner runway 2A is defined by guide rails 2a' and 2b, while the outer runway 2B is defined by guide rails 2a' and 2c. As shown in FIG. 1, terminal portions 2a'a and 2c' of the guide rails 2a'' and 2c of the outer runway 2B are inwardly curved and connect with terminals of guide rails 1a and 1c of the outer path 1B of the first runway 1, respectively.

Each of the track sections C1 to C4 has at its one end a male joint 4 and at its other end a female joint 5 so that by engaging the male joint 4 of each track section with the female joint 5 of the adjoining track section, the track sections C1 to C4 can be securely coupled together.

A retractable stopper 6 projects upwardly through an aperture 7 formed in plate portion C4a of the fourth track section C4 at an outer portion thereof which constitutes a part of the outer path 1B of the first runway 1. This stopper 6 is pivotally supported on the underside of the plate portion C4a and is resiliently biased upwardly by a spring means, not shown. A retractable projection 8 projects also upwardly through an aperture 9 formed in the plate portion C4a at an inner portion thereof which constitutes a part of the inner path A of the first runway 1. This projection 8 is integrally formed with said stopper 6 so that when the projection 8 is depressed, the stopper 6 is caused to be retracted into its aperture 7.

In the illustrated embodiment, the couple of mobile objects A and B are symmetrically shaped so that when the two objects A and B are coupled together in side by side relationship, they appear to be a single vehicle. The mobile objects A and B comprise chassises A1 and B1, bodies A2 and B2, front wheels A3a and A3b, B3a and B3b and rear wheels A4a and A4b, B4a, and B4b, respectively. One A of the objects is provided with a battery-operated motor M which drives the rear wheels A4a and A4b for rotation through the medium of a gear train 10. However, the other B of the objects is not provided with such self-propelling means.

The objects A and B are provided with projections 11 and 12 which depend from lower surfaces of the chassises A1 and B1, respectively. These projections 11 and 12 of the objects are adaped to be engaged with the stopper 6 and projection 8 of the first runway 1, respectively.

One B of the two objects is provided, at an upper portion of the inner side wall B2' of the body B2, with a horizontally extending recess 13 which opens in lateral and rearward directions and which is provided with a stepped portion 13'. This recess 13 is adapted to receive a horizontally extending engaging projection 14 which is provided on an upper portion of the inner side wall A2' of the body A2 of the other object A and which projects laterally therefrom. This projection 14 is provided with a hook portion 14' which is adapted to be engaged with said stepped portion 13' of said recess 13.

When it is desired to operate the toy, first, the two mobile objects A and B are coupled together in side by side relationship by engaging said projection 14 with said recess 13. Whereupon, the coupled objects A and B are placed on the first runway 1 in such way that the front wheels A3a and A3b and rear wheels A4a and A4b of the motor-driven object A are brought into contact with the inner path 1A and that the front wheels B3a and B3b and rear wheels B4a and B4b of the other object B are brought into contact with the outer path 1B. In this case, it is to be noted that the coupled objects must be placed on the track so that they can travel thereover in counter-clockwise direction as viewed in FIG. 1. Then, as the motor of the object A is actuated, the object A starts travelling over the first runway portion 1 in the counter-clockwise direction, being accompanied with the other object B.

Figure 12:
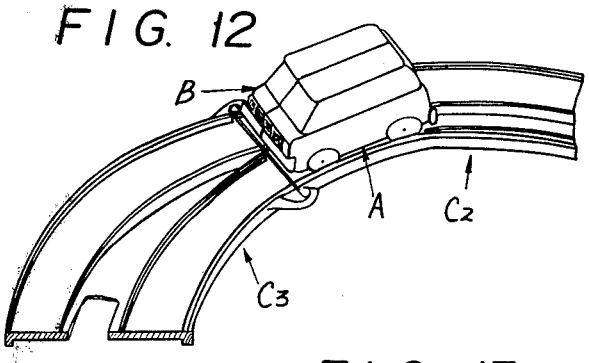
Figure 13:
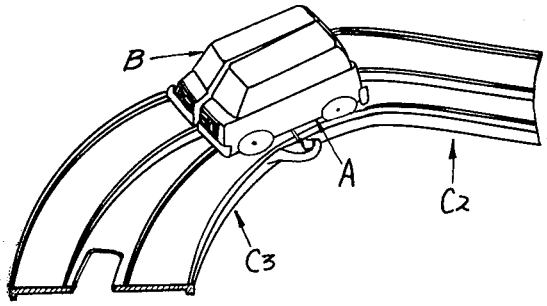
FIG. 13 is a perspective view illustrating the state in which the coupled objects are being separated from one another in the course of travelling over the track.

As the coupled objects A and B reach and pass the diverging junction 1' (see FIGS. 12 and 13), the inner adjoining front wheels A3b and B3b of the objects A and B are brought into contact with the diverging portion of the two central rails 2a' and 2a'' which may be called "a frog-like portion" and are guided thereby in the diverging directions, causing front portions of the coupled objects A and B to be slightly separated from one another, as shown in FIG. 13.

Figure 14:
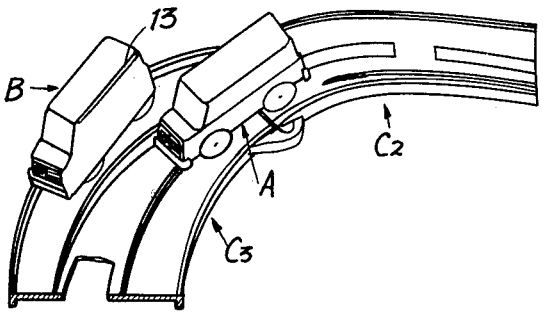
FIG. 14 is a perspective view illustrating the state in which the coupled objects have been separated from one another.

As the object B proceeds further, while being pulled by the other motor-driven object A, and advances beyond one end 1' of the first runway onto the outer runway 2B, it is placed in a forwardly inclined position on the aforementioned grade or slope of the third track section C3 and accordingly, it is caused to travel downwardly over the grade by its own weight. In this case, since the object B has not its own self-propelling mechanism which tends to brake it during its travel over the grade, it can descend along the grade more quickly than the other motor-driven object A. Thus, during travel of the two objects A and B over the grade of the track section C3, the recess 13 of the object B is caused to be released out of the engagement with the projection 14 of the other object A, thus causing the two objects A and B to be completely separated from another, as illustrated in FIG. 14.

Figure 15:
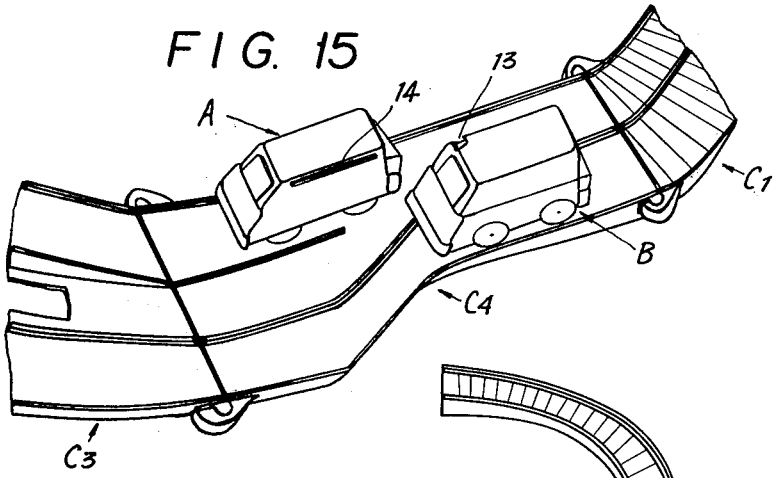
FIG. 15 is a perspective view illustrating the state in which the separate objects are about to be coupled together.

Then, the object B descends further along said grade of the outer runway 2B and advances into the outer path 1B of the first runway 1 by its own inertia faster than the other motor-driven object A and continues its travel until it is stopped by said stopper 6 (see FIG. 15). It will be apparent that before entering the outer path 1B, the object B is guided by the inwardly curved terminal portions 2a''a and 2c' of the rails 2a'' and 2c to approach the inner path 1A. Then, shortly after the object B is stopped by said stopper 6, the other motor-driven object A will arrive at the portion of the inner path 1A where the retractable projection 8 is located to couple with the object B kept waiting by the stopper 6 for the other object A. In this instance, before the depending projection 12 of object A is engaged with the retractable projection 8, the horizontally extending engaging projection 14 of the object A is adapted to be inserted in the mating recess 13 of the other object B for engagement through the rear opening thereof. Accordingly, while object B is kept waiting by said stopper 6, the motor-driven object A couples with it in the manner described by its own driving force.

Then, as soon as the two objects A and B are thus coupled together in side by side relationship, the depending projection 12 of object A is brought into contact with said retractable projection 8 to depress it. As this projection 8 is depressed in this manner, the stopper 6 integral with it is caused to be depressed with it to release the depending projection 11 of object B. Immediately upon this projection 11 is released from the stopper 6, the coupled objects A and B resumes their travel over the first runway 1 (see FIG. 16).

Figure 10:
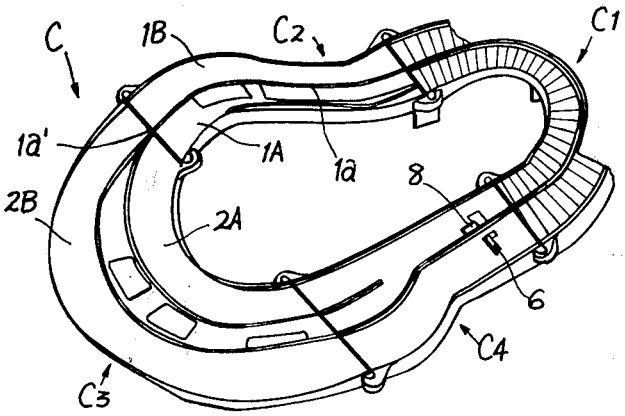
FIG. 10 is a perspective view of the track shown in FIG. 1.
Figure 11:
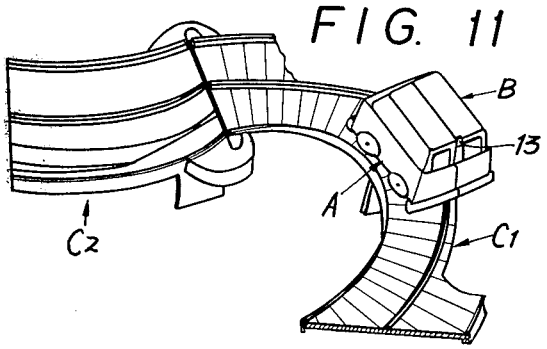
FIGS. 11 and 12 are perspective views illustrating the state in which the mobile objects are travelling over the track in their state of being coupled together in side by side relationship.
Figure 16:
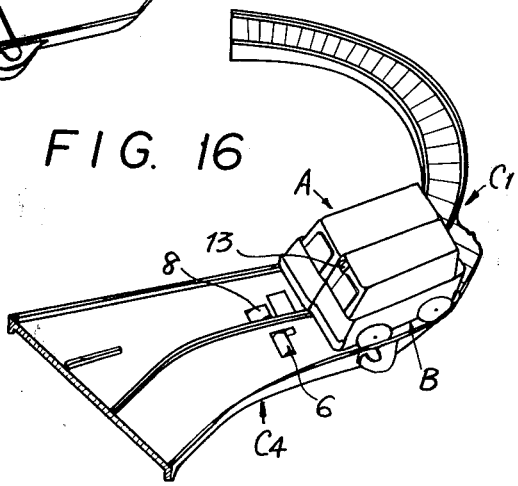
FIG. 16 is a perspective view showing the state in which the separate objects have been coupled together during their travel over the track.

It should be noted that although the outer path portion of the curved track section C1 is largely cut away at 3 as shown in FIGS. 1, 10 and 16, the object B can bridge over the track section C1 without falling off, since, as previously referred to, the objects A and B are securely coupled together by the engagement of the hook 14' of said projection 14 with the stepped portion 13' of said engaging recess 13. During the passage, object B is kept supported by the other motor-driven object A. Next, as the coupled objects A and B reach and pass said diverging junction or portion past the curved track section C1, they are caused to be split again in the manner aforementioned, and the objects A and B thus split couple together again during their travel as aforementioned.

While the particular embodiment of the invention has been illustrated and described, modifications thereof will readily occur to those skilled in the art. For example, the particular arrangements for coupling the two objects, such as the coupling means disclosed can be replaced by other devices, such as a magnet device. Further, the guide rails disclosed, can be replaced by guide grooves equivalent thereto. Furthermore, the specific devices provided on the track for splitting the two coupled objects and for coupling the two separate objects together can also be replaced by other devices equivalent thereto. Moreover, the mobile objects in the form of a vehicle as disclosed can be also replaced by other objects without wheels, such as slidable objects. It should be understood therefore that the invention is not limited to the particular embodiment disclosed.

What I claim is:

1. A toy comprising, in combination, a couple of mobile objects arranged to be detachably coupled together in side by side relationship and a track on which said objects are adapted to travel, said track comprising a first runway for guiding the objects in their state of being coupled together in side by side relationship and a pair of second runways for separating the coupled objects and for guiding the objects in their state of being separated from one another, said second runways diverging from said first runway so that as the coupled objects travelling along said first runway pass along the diverging portion, said coupled objects are adapted to be separated from one another.

2. A toy as claimed in claim 1, wherein said track is composed of a plurality of track sections in the form of an endless track and is provided with means for coupling said mobile objects together in side by side relationship in the course of their travel so that during their travel along said endless track, they can alternately perform a coupling action and a separating action, repeatedly.

3. A toy as claimed in claim 2, wherein said means for coupling said mobile objects together in side by side relationship comprises a stopper for stopping one of said objects and a projection adapted to be depressed by the other of said objects as the latter comes into contact with the former, said stopper being connected to said projection so that as the latter is depressed, the former is caused to be depressed in operative connection with the latter.

4. A toy as claimed in claim 1, wherein said first runway comprises a first path of travel for one of said objects and a second path of travel for the other of said objects, said first and second paths leading to said pair of second runways, respectively.

5. A toy as claimed in claim 1, wherein one of said objects is provided, on one side thereof, with an engaging projection, while the other of said objects is provided, on one side thereof, with an engaging recess so that by engaging said projection with said recess, said objects can be coupled together in side by side relationship.

6. A toy as claimed in claim 1, wherein each of said objects is a four-wheeled toy vehicle.

7. A toy as claimed in claim 5, wherein only one of said objects is provided with driving means.

* * * * *